United States Patent [19]

Bell

[11] Patent Number: 4,836,391

[45] Date of Patent: Jun. 6, 1989

[54] PIANO ROLL CABINET

[76] Inventor: Jan E. Bell, 222 S. Hubbard, Horicon, Wis. 53032

[21] Appl. No.: 69,650

[22] Filed: Jul. 6, 1987

[51] Int. Cl.[4] ..... A47F 5/00

[52] U.S. Cl. ..... 211/60.1; 211/126; 211/194

[58] Field of Search ..... 211/135, 126, 60.1, 211/194, 74, 188, 44, 34, 36, 37, 45; 108/91

[56] References Cited

U.S. PATENT DOCUMENTS

| | | | |
|---|---|---|---|
| 460,748 | 10/1891 | Hartmann | 108/91 |
| 2,008,748 | 7/1935 | Crow | 211/34 |
| 2,079,385 | 5/1937 | Ross et al. | 211/10 |
| 2,635,027 | 4/1953 | Rasmussen | 211/135 X |
| 3,169,812 | 2/1965 | Gronkvist et al. | 211/45 X |
| 4,056,295 | 11/1977 | Downing | 108/91 X |
| 4,181,352 | 1/1980 | Bumpus | 108/91 X |
| 4,196,812 | 4/1980 | McInnis | 211/194 X |
| 4,282,977 | 8/1981 | DiLorenzo | 211/74 |

*Primary Examiner*—Robert W. Gibson, Jr.
*Attorney, Agent, or Firm*—Donald Cayen

[57] ABSTRACT

A cabinet for storing piano roll boxes comprises a five-sided housing with an open front. Arrays of horizontal support rods extend within the housing. The rods are arranged in pairs, with one rod of each pair being mounted near the housing open front and the second rod being mounted near the housing back wall. The first rod of each pair is higher than the second rod, so that the piano roll boxes tend to slide downwardly and contact the housing back wall. Two or more cabinets may be stacked on top of each other. Positive retaining means is included to hold stacked cabinets in alignment. The top cabinet may have the support rods of each pair in horizontal alignment for easy identification and removal of the piano roll boxes.

3 Claims, 2 Drawing Sheets

PIANO ROLL CABINET

BACKGROUND OF THE INVENTION

1. Field of the Invention.

This invention pertains to furniture, and more particularly to furniture for arranging and storing music rolls.

2. Description of the Prior Art. Despite the prevalence of electronic music generators, player pianos continue to be popular, both as items of furniture and as sources of entertainment. Although player pianos have long been in widespread use, the problem of handling and storing the piano music rolls has not been satisfactorily solved. Owners of player pianos treat their music rolls with great care, and they take pains to store the rolls properly. Nevertheless, suitable storage devices for piano rolls are still lacking.

U.S. Pat. Nos. 1,184,569 and 1,423,078 disclose music roll cabinets that include handsome pieces of furniture. The rolls are stored individually within the cabinets. However, the cabinets described in the two patents have no provision for storing the boxes or other containers that protect the individual piano rolls. As a result, the empty boxes must be stored at locations separate from the music. That procedure is wasteful of space and subjects the boxes to loss or damage. Another disadvantage of storing rolls and boxes separately is that the rolls themselves must be handled when inserting them into the storage cabinets, which subjects them to undesirable wear and accidental tearing. In addition, it is evident that the music roll cabinets of the two previously mentioned patents are quite expensive.

Thus, a need exists for suitable equipment that conveniently and safely stores music rolls.

SUMMARY OF THE INVENTION

In accordance with the present invention, an inexpensive cabinet is provided that stores and indexes piano rolls in a protective and attractive manner. This is accomplished by apparatus that includes a five-sided housing together with horizontally disposed supports.

The cabinet housing is constructed with orthogonal top, bottom, back, and side walls, leaving an open front. The depth of the cabinet housing is designed to totally enclose commercial piano roll boxes with the longitudinal axes of the boxes generally perpendicular to the plane of the cabinet open front and with one end of the boxes contacting the cabinet back wall. Mounted to and extending between the two opposed side walls are a series of horizontal supports, which may be in the form of long rods lying parallel to the plane of the open front. The rods are arranged in pairs, with each pair consisting of a front rod and a back rod. The front rods are held in the two opposed side walls at locations near the open front of the cabinet. The back rods are mounted to the side walls close to the cabinet back wall. Consequently, boxes placed on a pair of rods are stably supported near their ends. The back rod of each pair is preferably located slightly lower than the front rod of the pair. Thus, the piano roll boxes are tilted at an angle to the horizontal on a pair of rods such that the boxes tend to slide downwardly against the housing back wall.

The vertical spacing between successive front and back rods is set to accommodate the piano roll boxes with only a small clearance between the top of a box and the next higher rod. In that way, a large number of piano rolls can be stored in a minimum space.

The cabinet bottom wall serves as the support for the back ends of the lowermost row of piano rolls. To increase the rigidity of the cabinet and to provide tilting to the lowermost row of piano rolls, the lowermost front rod may be replaced with a strip of material attached to the housing bottom wall and extending to the side walls.

Further in accordance with the present invention, the individual piano roll cabinets may be stacked on each other. To stably hold two or more stacked cabinets in place, short but sturdy reinforcing plates may be fastened to the corresponding walls of adjacent cabinets. Alternately, a supporting cabinet may be constructed with a housing having shoulders that rise a short distance above the top wall on three sides. The inside surfaces of the shoulders are flush with the outside surfaces of the housing side and back walls. In that manner, a second cabinet is stably nestable within the confines of the shoulders on a lower cabinet. For user convenience with a stack of cabinets, the top cabinet is preferably constructed with horizontally aligned pairs of support rods. In that manner, the piano roll boxes in the top cabinet are easier to identify and retrieve than if they were stored at an angle.

Other advantages and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
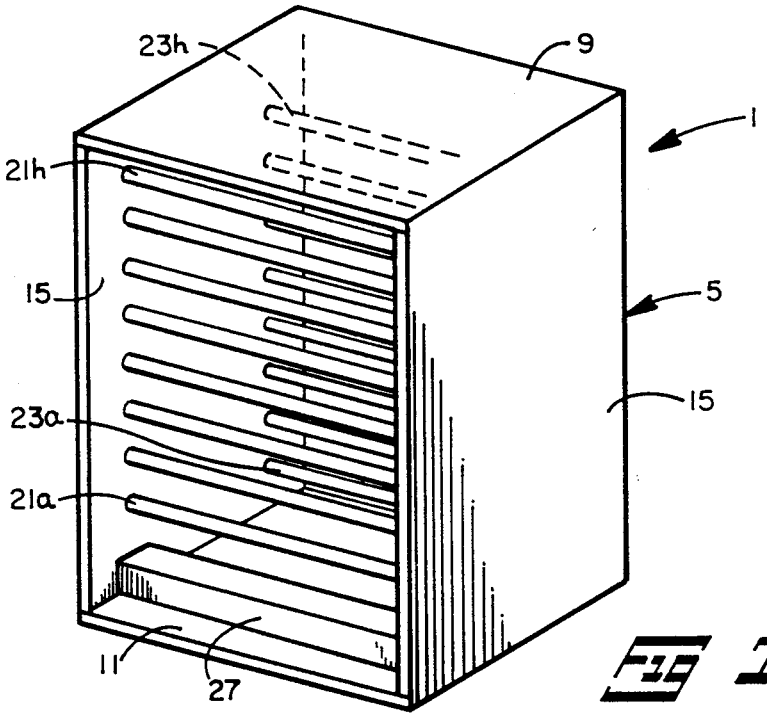
FIG. 1 is a perspective view of the piano roll cabinet of the present invention.
Figure 2:
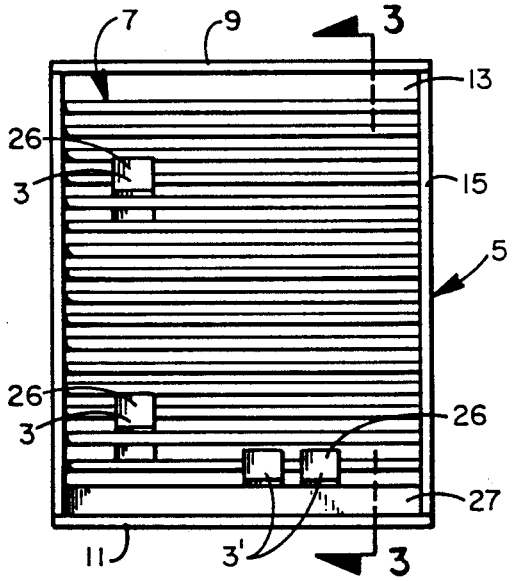
FIG. 2 is a front view of the piano roll cabinet.
Figure 3:
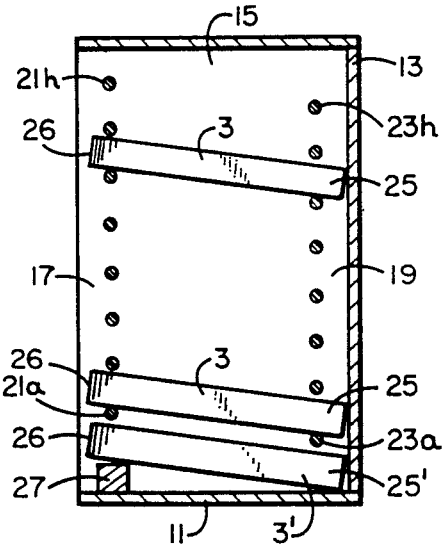
FIG. 3 is a cross sectional view taken along lines 3—3 of FIG. 2.

Referring to FIGS. 1–3, a piano roll cabinet 1 is illustrated that includes the present invention. The piano roll cabinet is particularly useful for storing and arranging rectangular music roll boxes 3, but it will be understood that the invention is not limited to music storage applications.

The piano roll cabinet 1 comprises a five-sided housing 5 and a plurality of support rods 7. The housing 5 includes a roof 9, floor 11, back wall 13, and opposed side walls 15. The roof 9, floor 11, and walls 13 and 15 are assembled into an open front cabinet having a forward section 17 and a rearward section 19.

To conveniently and neatly store the piano roll boxes 3 with their longitudinal axes perpendicular to the plane of the housing open front, the support rods 7 are arranged in pairs 21a, **23*a* to 21*h*, 23*h*. Front rods 21*a*–21*h* are mounted to and extend between the side walls 15 in the forward section 17 of the housing 5. Back rods 23*a*–23*h* are similarly mounted in the rearward section 19 of the housing. As best illustrated in FIG. 3, the front rods 21 of each pair are horizontally spaced above the corresponding back rod 23. A piano roll box is inserted into the open front of the cabinet 1 and placed on a selected pair of rods 21, 23. The box tends to slide downwardly on the rods toward the housing back wall 13, until the box interior end 25 contacts the housing back wall. In that manner, the boxes are held securely in place with their longitudinal axes at an angle to the horizontal against accidentally falling out. At the same time, the box front ends 26 are exposed for easy reading of the box labels. The adjacent pairs of rods 21, 23** are vertically spaced to permit ready insertion and removal of the boxes while still permitting dense storage.

The back ends 25' of the lowermost piano roll boxes 3' rest on the cabinet floor 11. To provide additional strength and rigidity to the housing 5, the front support for the boxes 3' may be in the form of a brace 27 that is fastened to the housing floor and to the side walls 15.

The piano roll cabinet 1 of the present invention may be made of any suitable size and shape. However, I have found that a particular desirable cabinet is approximately 24 inches high, 18 inches wide, and 12¾ inches deep. The support rods 21, 23 may be 0.38 inches in diameter, in which case the vertical spacing between successive front and back rods is 2.5 inches. The vertical offset between the corresponding rods 21, 23 of a pair is approximately one inch. With the dimensions as given, 64 conventional piano roll boxes 3 having two inch square cross sections can be stored in a dense but easy to retrieve manner.

Any appropriate material, such as metal or plastic, may be used to construct a cabinet 1 of the present invention. An especially suitable material for the housing 5 is plywood, together with wooden dowels for the support rods 21, 23. That combination contributes to a very attractive piece of furniture. If desired, a door, not illustrated, can be mounted to the front of the cabinet for completely enclosing the piano rolls. A further feature of the cabinet is that it may be sold to the consumer either completely assembled or in kit form. Consequently, the player piano owner can derive satisfaction from assembling the cabinet as well as from the finished product.

Figure 4:
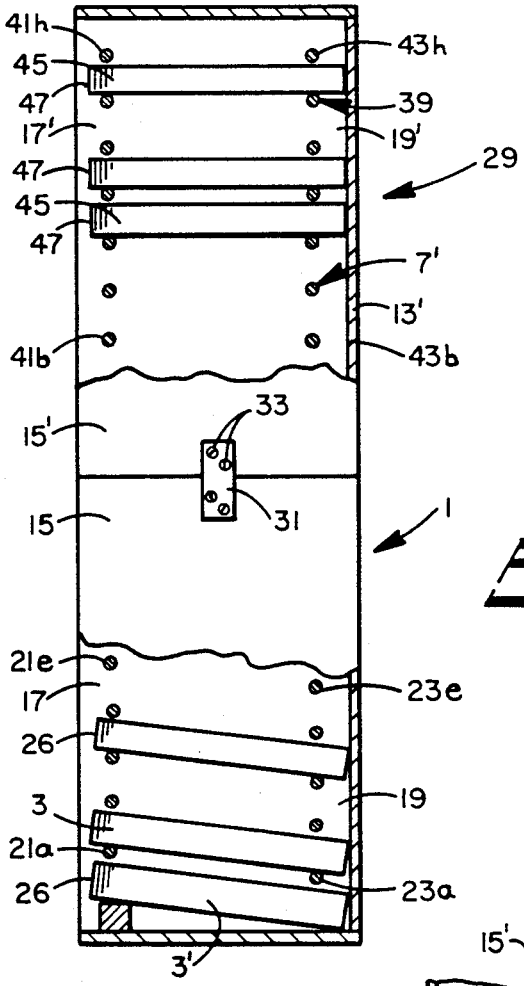
FIG. 4 is a side view, partially in cross section, of a stack of piano roll cabinets.

Further in accordance with the present invention, two or more cabinets may be stacked on top of one another. Turning to FIG. 4, a stack of two cabinets is shown. It will be understood, of course, that more than two cabinets may be placed in a stack. To stably retain an upper cabinet 29 in place on a lower cabinet 1, one or more attractive brass plates 31 are fastened to the side walls 15 of the cabinet 1 and to the corresponding walls 15' of the upper cabinet 29. Fastening of the plate 31 may be by conventional brass fasteners 33. A plate may also be used in conjunction with the cabinet back walls 13 and 13', if desired. Alternately, a stack of cabinets may be held stably in place by means of a shoulder that extends around three sides of the lower cabinet roof 9. In the construction illustrated in FIG. 5, the shoulder consists of a trio of strips 35 that are screwed or otherwise fastened to the top ends of the side and back walls of the lower cabinet 1. The strips 35 extend approximately one inch above the roof. Consequently, an upper cabinet, such as cabinet 29, can nest within the perimeter defined by the shoulders created by the strips.

Figure 5:
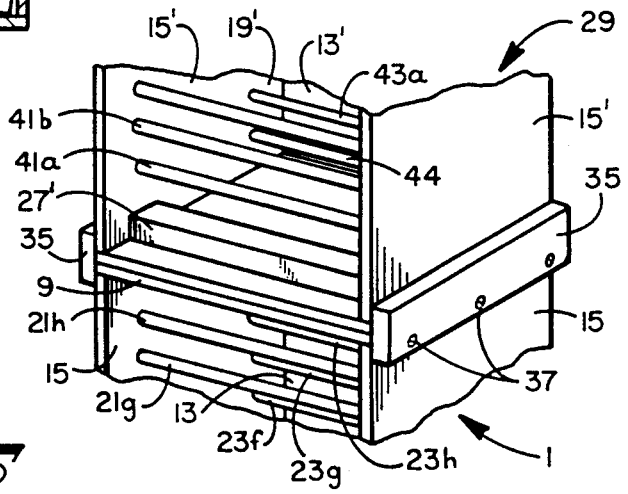
FIG. 5 is a partial perspective view of a pair of stacked cabinets shown on a slightly reduced scale.

It is a feature of the present invention that the top cabinet 29 of a stack may be fabricated in a slightly different manner than lower cabinets 1. As shown in FIGS. 4 and 5, the support rods 7' of the top cabinet comprise pairs of rods **41*a*, 41*h* to 43*a*, 43*h*. The front rods 41*a*–41*h* are horizontally aligned with the corresponding back rods 43*a*–43*h*. An individual back rod 44 near the rearward section 19' of the cabinet 29 is used to cooperate with the front brace 27' for holding a lowermost piano roll box, not illustrated in FIG. 5. With the horizontally aligned support rods, the piano roll boxes 45 stored in the top cabinet 29 are more easily retrieved and the labels on the box ends 47 are more easily read than if the boxes were supported at an angle as in the lower cabinets. This is especially important if three or more cabinets are stacked on each other. The modified cabinet 29** with horizontally aligned support rods is also desirable if the cabinet is placed on a shelf or other elevated location.

The top cabinet 29 may have the same dimensions as the lower cabinets 1. Specifically, in FIG. 4, the top cabinet is shown with the same height as the lower cabinet. However, it is preferred that the top cabinet be somewhat shorter than the lower cabinets. A desirable height for the top cabinet is approximately 16 inches, with pairs of rods 41, 43 sufficient to store 48 piano roll boxes 45.

Thus, it is apparent that there has been provided, in accordance with the invention, a piano roll cabinet that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A piano roll cabinet comprising:

a. a housing having five generally orthogonal walls to form a five-sided enclosure with an open front that defines a vertical plane, the distance between the open front and the opposed back wall being approximately 12.75 inches to thereby accommodate a piano roll with the longitudinal axis thereof generally perpendicular to the open front plane;

b. an array of generally horizontal support rods fixedly mounted in the housing for supporting a plurality of piano rolls inside the housing with the piano roll longitudinal axes generally perpendicular to the housing open front, the support rods being arranged into first and second generally vertically aligned columns with the first column being supported adjacent the housing open front and the second column being mounted adjacent the housing opposed back wall, the vertical spacings between the respective support rods in the first and second columns being approximately 2.5 inches to receive the piano rolls therebetween; and c. a brace extending along the housing bottom wall in vertical alignment with the first column of support rods and extending a predetermined distance above the housing bottom wall to support one end of a piano roll adjacent the housing open front, the housing bottom wall supporting the piano roll second end adjacent the housing back wall, so that a piano roll can be inserted completely into the housing open front and stably supported near the ends thereof by selected ones of the support rods in the first and second arrays thereof.

2. Apparatus for storing elongated music rolls comprising:

a. a first cabinet comprising:

i. a five-sided housing having an open front forming a generally vertical plane and an opposed back wall, the distance between the housing open front and the opposed back wall being approximately 12.75 inches to thereby completely receive a music roll with the longitudinal axis thereof generally perpendicular to the plane of the open front; and ii. a plurality of pairs of front and back support rods fixedly mounted in the housing and lying in planes parallel to the housing open front, the support rods of each pair being horizontally spaced apart a distance sufficient to stably support a music roll, the pairs of support rods being vertically spaced apart approximately 2.5 inches to thereby compactly receive music rolls within the first cabinet;

b. a second music cabinet comprising:

i. a five-sided housing having an open front forming a generally vertical plane and an opposed back wall, the distance between the housing open front and the opposed back wall being approximately 12.75 inches to thereby completely receive a music roll with the longitudinal axis thereof generally perpendicular to the plane of the open front; and ii. a plurality of pairs of front and back support rods fixedly mounted in the housing and lying in planes parallel to the housing open front, the support rods of each pair being horizontally spaced apart a distance sufficient to stably support a music roll, the pairs of support rods being vertically spaced apart approximately 2.5 inches to thereby compactly receive music rolls within the second cabinet, the second music roll cabinet being placed on top of the first music roll cabinet; and c. means for positively retaining the second cabinet in place on top of the first cabinet.

3. The apparatus of claim 2 wherein at least one of the first and second music roll cabinets further comprises a brace extending along the housing bottom side in vertical alignment with the front support rods of the pairs thereof for supporting one end of a music roll near the housing open front, and wherein the second end of the music roll is supported on the housing bottom side adjacent the opposed back wall.

* * * * *